US008104982B2

(12) United States Patent
Duru

(10) Patent No.: US 8,104,982 B2
(45) Date of Patent: Jan. 31, 2012

(54) DEVICE FOR LOADING AND APPLYING A COSMETIC COMPOSITION

(75) Inventor: Nicolas Duru, Paris (FR)

(73) Assignee: L'Oreal, Paris (FR)

( * ) Notice: Subject to any disclaimer, the term of this patent is extended or adjusted under 35 U.S.C. 154(b) by 631 days.

(21) Appl. No.: 12/339,779

(22) Filed: Dec. 19, 2008

(65) Prior Publication Data

US 2009/0162128 A1 Jun. 25, 2009

Related U.S. Application Data

(60) Provisional application No. 61/021,239, filed on Jan. 15, 2008.

(30) Foreign Application Priority Data

Dec. 20, 2007 (FR) ..... 07 60161

(51) Int. Cl.
*A46B 11/08* (2006.01)

(52) U.S. Cl. ..... 401/2; 401/1

(58) Field of Classification Search ..... 401/1–3
See application file for complete search history.

(56) References Cited

U.S. PATENT DOCUMENTS

| | | | | |
|---|---|---|---|---|
| 5,775,344 | A * | 7/1998 | Clay | 132/218 |
| 5,853,010 | A | 12/1998 | Suh | |
| 7,090,420 | B2 * | 8/2006 | De La Poterie et al. | 401/1 |
| 7,108,438 | B2 * | 9/2006 | Fontaine | 401/1 |
| 7,753,609 | B2 * | 7/2010 | Bouix et al. | 401/129 |
| 2005/0220828 | A1 | 10/2005 | Ullom et al. | |
| 2006/0005851 | A1 | 1/2006 | Cho | |
| 2006/0032512 | A1 | 2/2006 | Kress et al. | |

FOREIGN PATENT DOCUMENTS

| | | | |
|---|---|---|---|
| EP | 1 466 541 | A1 | 10/2004 |
| JP | 2003-310335 | A | 11/2003 |
| WO | WO 00/40112 | A1 | 7/2000 |
| WO | WO 2007/114551 | A1 | 10/2007 |
| WO | WO 2007/143370 | A2 | 12/2007 |
| WO | WO 2007/143430 | A2 | 12/2007 |
| WO | WO 2007/143430 | A3 | 12/2007 |

OTHER PUBLICATIONS

French Search Report from French Application No. FR 07 60159 filed Dec. 20, 2007.
French Search Report from French Application No. FR 07 60161 filed Dec. 20, 2007.
Co-pending U.S. Appl. No. 12/338,004, filed Dec. 18, 2008.
European Search Report, from counterpart European Patent Application No. EP 08 17 1917, dated May 8, 2009.

* cited by examiner

*Primary Examiner* — Huyen Le
(74) *Attorney, Agent, or Firm* — O'Brien Jones, PLLC

(57) ABSTRACT

A device for loading and applying a cosmetic composition may comprise an applicator comprising an electric heater member, a container containing the composition, the container comprising a housing configured to receive at least part of the applicator so as to load the applicator with the composition, and an electrical circuit configured to power the heater member. The circuit may be configured so that the power supply to the heater member is automatically modified, leading to an increase in the electric power that is dissipated by the heater member when said heater member is received in the housing, when a predefined condition relating to the at least part of the applicator being received in the housing is satisfied.

21 Claims, 4 Drawing Sheets

DEVICE FOR LOADING AND APPLYING A COSMETIC COMPOSITION

This application claims the benefits of priority of French Application No. 07 60161 filed on Dec. 20, 2007 and U.S. Provisional Application No. 61/021,239 filed on Jan. 15, 2008, which is incorporated by reference herein.

TECHNICAL FIELD

The present teachings relate to a device for loading and applying a composition, such as, for example, a cosmetic composition, the device including a heater member.

BACKGROUND

In order to apply makeup to the eyelashes, it has been proposed to use an applicator that comprises a heater member that is powered electrically by one or more optionally-rechargeable batteries present in the applicator.

By way of example, the composition is applied to the eyelashes by means of a brush or a comb, and the applicator including the heater member is then used to add finishing touches to the eyelash makeup process, such as, for example, lengthening or curling the eyelashes.

It has also been proposed to use the applicator provided with the heater member for applying the composition. In this event and by way of example, the composition is deposited in solid form in contact with the heater member, said heater member being brought to a temperature that is sufficient to cause the composition to soften and/or melt to a degree sufficient for application of the composition, for example, to coat the eyelashes.

During use, it is desirable that the temperature of the heater member not be too high, so as to avoid any risk of singeing the eyelashes or of burning the skin in the event of accidental contact with said heater member. For example, it is desirable that the temperature of the heater member during application not exceed about 65° C.

The heating up of the heater member, and the supply of heat needed to soften and/or melt the composition brought into contact therewith, are a function of the thermal inertia of the applicator and a function of the electric power supplied to the heater member.

There exists a need to decrease the waiting time necessary to heat up the heater member, and to facilitate loading of the applicator with composition, when necessary.

SUMMARY

Various exemplary embodiments of the present teachings may satisfy one or more of the aforementioned needs.

Various exemplary embodiments of the present teachings provide a device for loading and for applying a cosmetic composition, the device comprising an applicator comprising an electric heater member, and a container containing the composition wherein the container comprises a housing in which at least part of the applicator is configured to be received so as to load the applicator with composition. The device may also comprise an electrical power circuit that is configured to automatically modify a power supply to the heater member, leading to an increase in the electric power that is dissipated by the heater member when said heater member is received in the housing, when a predefined condition relating to the at least part of the applicator being inserted into the housing is satisfied.

The heater member may not be powered at all before being inserted into the housing.

The applicator may include at least one independent electrical energy source powering the electrical circuit. By way of example, the independent electrical energy source comprises one or more optionally-rechargeable batteries.

In various exemplary embodiments of the present teachings, it is possible to power the heater member with more electric power when said heater member is inserted into the housing, and thus without any risk of the user being exposed to the heater member.

If so desired, this makes it possible to bring the heater member momentarily up to a temperature that is higher than the temperature authorized during application of the composition. While the heater member is in the housing, temperature regulation of the heater member, if any, may be deactivated, so as to enable the heater member to be brought to a maximum temperature, and then, once the applicator is removed from the container, the temperature regulation, if any, may be activated once again, so as to maintain the heater member at a service temperature that is compatible with the heater member being in contact with keratinous materials.

In addition, various exemplary embodiments may make it possible to load the applicator automatically with composition as soon as it is reinserted into the container, thereby facilitating use of the device. The result of bringing the heater member to a temperature that is higher than its service temperature, when the heater member is in the housing of the container, may make it easier for the composition to melt when it comes into contact with the heater member, thereby improving the loading of the heater member with composition and/or making it possible to have a more uniform distribution of melted composition on the heater member.

If so desired, various exemplary embodiments of the present teachings may also make it possible to power the heater member temporarily from an auxiliary electricity source that is present in the container, thereby making it possible to preserve the applicator's source of electricity and increase its battery life. By way of example, the energy source of the applicator may be used merely to maintain the heater member at the service temperature.

In an exemplary embodiment, once the heater member is at least partially inserted into the housing, the modification of the power supply to the heater member is accompanied by an increase in the electric power dissipated by the heater member, e.g. following an increase in the voltage supplied to the heater member. The electric power dissipated by the heater member when said heater member is at least partially inserted into the housing, lies in the range 0.1 watts (W) to 2 W, for example. While the heater member is merely being maintained at its service temperature, the electric power dissipated by the heater member may be less, e.g. lying in the range 0.3 W to 0.6 W.

The increase in the electric power dissipated by the heater member may lead to an increase in the temperature of the heater member, bringing said heater member up to at least 85° C., for example.

The heater member need not be powered before being inserted into the housing. In a variant, the heater member may be powered in a first mode before being inserted into the housing. By way of example, the first powering mode of the heater member corresponds to supplying it with power that enables the heater member to be maintained at a service temperature enabling the user to apply the composition, e.g. a service temperature lying in the range 60° C. to 70° C.

The heater member may automatically return to the first powering mode when the applicator is removed from the housing of the container.

The electrical power circuit may be housed, at least in part, in the applicator.

The insertion of at least part of the applicator into the housing of the container may be detected in various ways, in particular by means of a switch carried by the applicator. The term "switch" should be understood broadly, and it encompasses electronic or electro-mechanical components and sets of components, and the switch may interact mechanically, magnetically, and/or optically with the container in order to change state.

The above-mentioned predefined condition leading to a modification in the power supplied to the heater member is thus a modification in the state of the switch while the applicator is being inserted into the housing of the container, for example.

By way of example only, the switch is a reed switch that is sensitive to a magnetic field, and the container may include a magnet. The switch and the magnet may be disposed in such a manner as to come to face each other when the applicator is inserted into the housing, so that the magnetic field generated by the magnet modifies the state of the switch.

The switch may be a switch that provides transient contact, e.g. a pushbutton, and the housing may cause the switch to pass mechanically from a first position to a second position, thereby modifying its state when the applicator is inserted into the housing.

The switch may also provide optical detection.

The applicator may also include a sensor that is sensitive to pressure exerted on the heater member. By way of example, the predefined condition is thus the detection of pressure exerted on the heater member that is greater than a predefined value.

As mentioned above, the container may include an auxiliary electrical energy source. By way of example, the auxiliary source comprises one or more optionally-rechargeable batteries or it may be connected to the mains.

The electrical circuit may include first electrical contacts, e.g. connected to the auxiliary source and projecting from the wall of the housing, and the applicator may include second electrical contacts that are configured to come into contact with the first contacts when the applicator is in the housing.

The predefined condition may be the first and second electrical contacts coming into contact. Making contact in this way may enable the heater member to be powered both by the electrical energy source of the applicator and by the auxiliary electrical energy source of the container, or merely by said auxiliary electrical energy source. Powering by means of the auxiliary source may enable the electrical energy source of the applicator to be used less, and may enable its battery life to be increased. Power may be provided by means of the auxiliary source so as to cause more electric power to be dissipated by the heater member. By way of example, the auxiliary source presents a voltage that is greater than the voltage of the independent electricity source of the applicator, e.g. a voltage that is 30% greater than the voltage of the energy source of the applicator.

Where appropriate, the auxiliary source may be used to recharge a battery housed in the applicator.

The electrical circuit may include a timer that is configured so that the modification in the power supply to the heater member occurs only for a predefined duration, e.g. the duration needed to load the heater member with composition and/or to heat up the heater member to its service temperature or to a higher temperature that makes it easier to take up the composition.

Thus, in an exemplary embodiment, each time the applicator is put back into the container, the heater member is powered to dissipate maximum electric power for a predefined duration, after which the power may be supplied to dissipate less electric power, e.g. no more than the power needed to maintain the heater member at its service temperature.

The device may also be configured so that when the applicator is in place on the container and is switched off, the user can switch the applicator on while leaving it on the container. In this event, the heater member may be powered to dissipate maximum power for a predefined duration, so that the heater member is heated up quickly.

The device may include an indicator that is configured to emit a visible and/or an audible signal when the heater member has reached its service temperature, or to inform the user that the heater member is being powered with higher power. By way of nonlimiting example, the visible signal may be, for example, a light, and the audible signal may be any of a variety of sounds.

The applicator may comprise a handle portion and an applicator head including the heater member.

In an exemplary embodiment, the housing of the container extends along a vertical axis when the container is placed on a plane horizontal surface, and the applicator head has a surface for coming into contact with keratinous materials that generally extend perpendicularly to the longitudinal axis of the applicator.

In a variant, the housing extends along a horizontal axis when the container is placed on a plane horizontal surface, and the applicator head has a surface for coming into contact with keratinous materials that generally extend parallel to the longitudinal axis of the applicator.

The composition present in the container may be in solid form, such as, for example, in the form of a powder, a compacted composition, beads or sprinkles. The composition also may be in the form of a gel. Those ordinarily skilled in the art are familiar with such forms of compositions.

The composition may be brought into contact with the heater member of the applicator in various ways.

By way of example, the composition is present in the bottom of the housing of the container, and the applicator takes up the composition as a result of the composition adhering to the heater member when said heater member is heated. By way of example, this occurs when the composition is in powder or compacted form in the bottom of the housing.

The composition may also be deposited on the heater member by being brought thereon from above, for example. This may occur when the composition is in powder form, gel form, or in the form of larger bodies, such as, for example, beads or sprinkles.

The applicator may also be dipped into the composition, so as to be loaded with composition.

By way of example, the composition is a composition for application to keratinous fibers, for example, mascara, e.g., mascara presenting a stringy character only when hot.

The container may be arranged to be refilled with composition, and, by way of example, includes a compartment having an opening that enables the content of a composition refill to be poured therein, e.g. a composition refill in powder form.

The container may also be unsuitable for filling by the user.

Where appropriate, the same applicator may be used with at least two containers, each containing a different composition. Each container may include ID (identification) mechanisms, e.g. electrical, optical, magnetic, or mechanical mechanisms, that make it possible to inform the applicator about the kind of composition contained in the container.

As a result of the applicator being informed in this way about the kind of composition, it is possible, for example, to bring the heater member automatically to a predefined temperature as a function of the composition contained in the container into which the applicator is to be put.

The container may be provided to receive the applicator when the applicator is not in use, the applicator being arranged to close the housing containing the composition, for example. In a variant and by way of example, the applicator may be stored when not in use other than on the container, and the container may include a closure member that is different from the applicator for closing the housing.

Various exemplary embodiments of the present teachings provide a method of loading an applicator with a cosmetic composition, including, for example, a care product, in which the method comprises at least partially inserting an applicator comprising a heater member into a container containing the composition to be loaded, determining if a predefined condition relating to the presence of the applicator in the container is satisfied, and automatically modifying the power supply to the heater member when the predefined condition is satisfied.

The heater member may be powered in a first mode before being inserted into the container, or, in a variant, need not be powered at all before being inserted into the container. After modifying the power supply, the heater member may be powered in a second mode, such that the temperature of the heater member increases.

The power supply to the heater member may be modified for as long as the predefined condition is satisfied, or, in a variant, for a predefined duration.

Other exemplary embodiments of the present teachings provide a device for loading and for applying a cosmetic, which device includes a heater member, said heater member comprising a resistor wire that is wound around a substrate.

By way of example, the wire is made of a cupro-nickel or a nickel-chromium alloy. The wire may optionally include outer electrical insulation. In an exemplary embodiment, the wire is made of nickel-chromium alloy insulated with polytetrafluoroethylene (PTFE). In a variant, the wire is made of enameled cupro-nickel alloy.

The wire may be disposed in the form of optionally-touching turns. Touching turns may make it easier to clean the heater member.

The substrate on which the wire is wound need not be electrically conductive, e.g. comprising a ceramic, silicone rubber, or some other plastics material that is sufficiently heat-resistant.

The substrate may be hollow and the wire may be disposed inside the substrate, at least in part. Alternatively, the substrate may be solid. The substrate may have the shape of a peg, a thin disk, or a plate.

The substrate may be overmolded or sintered onto the wire.

Other exemplary embodiments of the present teachings provide a device for applying a cosmetic composition or for adding finishing touches to makeup, the device including a heater member and an electrical circuit for powering the heater member, the circuit including control means configured to boost the electric power supplied to the heater member to dissipate power higher than the power needed to maintain it at its service temperature, e.g. lying in the range 60° C. to 70° C.

By way of example, the control means comprises a switch that is actuated by the user or that is actuated automatically while the device is being put into place on a container containing the composition to be loaded.

By way of example, the power supplied to the heater member is boosted by powering the member at a voltage that is greater than the voltage that enables it to be maintained at its service temperature, e.g. a voltage that is at least 30% greater. The power supply to the heater member may also be boosted by being powered with a higher duty ratio, e.g. being powered continuously during the power-boosting stage (duty ratio 100%), then at a lower duty ratio, where the duty ratio is a function of the depletion state of the energy source, for example.

The power supply for the heater member may be boosted for a predefined duration that is determined by a timer.

BRIEF DESCRIPTION OF THE DRAWINGS

The present teachings may be better understood on reading the following description of nonlimiting, exemplary embodiments thereof, and on examining the accompanying drawings, in which.

MORE DETAILED DESCRIPTION

Figure 1:
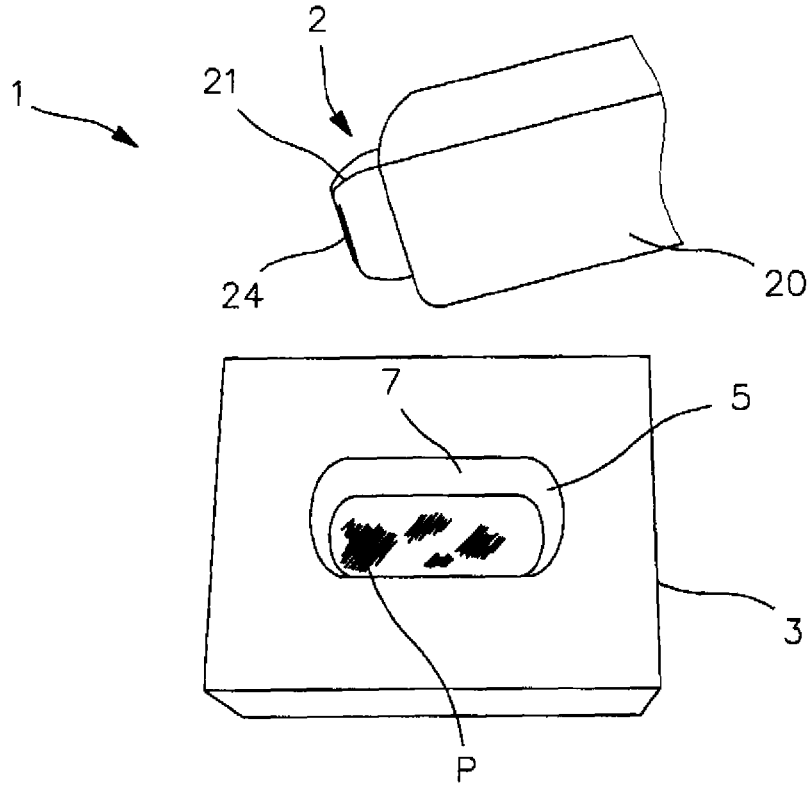
FIG. 1 is a partial perspective view of an exemplary embodiment of a device in accordance with the present teachings in a position wherein the applicator is not inserted into the container.
Figure 2:
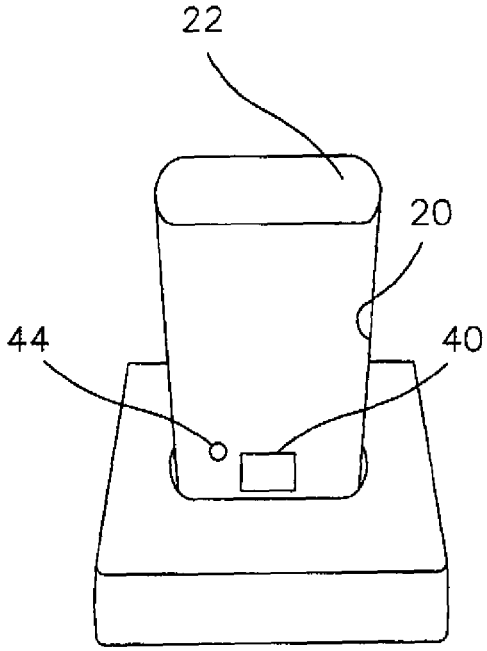
FIG. 2 shows the device of FIG. 1 in a position wherein the applicator is inserted in the container.
Figure 3:
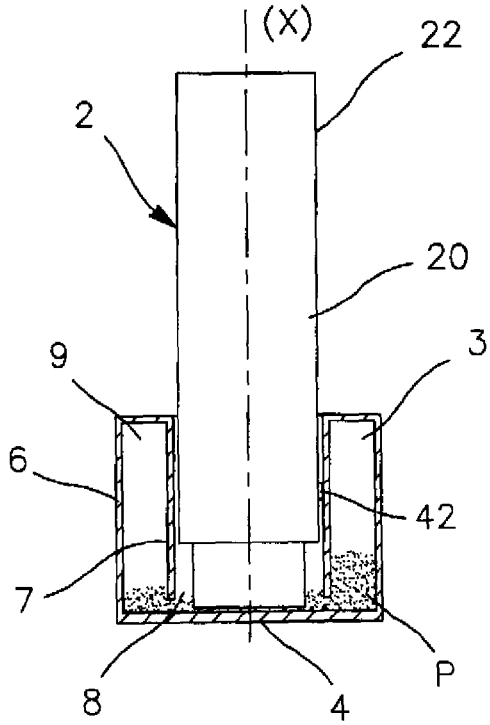
FIG. 3 is a longitudinal section view of the device of FIG. 2.

FIGS. 1 to 3 show a device 1 according to an exemplary embodiment of the present teachings.

The device 1 comprises a container 3 containing a composition P for application, and an applicator 2 for loading with the composition P and applying it to keratinous fibers, the skin, and/or mucous membranes, depending on the type of composition.

In the embodiment shown, the composition P is a powder that is contained in a reservoir 9 (see FIG. 3) of the container 3, the reservoir 9 communicating with a housing 5 for receiving the applicator.

The container 3 is arranged to enable a certain amount of composition P coming from the reservoir 9 to reach the housing 5 in order to be taken therefrom by the applicator 2.

In the embodiment shown, the housing 5 is supplied with composition via a passage 8 that is formed between a partition 7 that separates the housing 5 from the reservoir 9 and a wall 4 that defines the bottom of the housing 5. The passage 8 can extend all around the housing 5. For example, the reservoir 9 may have an annular shape.

In order to feed the housing 5 with composition, the user can, in the absence of the applicator 2, tap on the container 3 for example, so that the composition P flows by gravity through the passage 8 into the housing 5, and becomes distributed in the bottom of said housing 5.

The applicator 2 includes a casing 20 that serves as a handle portion and that is provided at one end of an applicator head 21 that carries a heater member 24. The applicator head 21 is configured to be inserted in the housing 5. The housing 5 is arranged to keep the applicator 2 oriented substantially vertically when the container 3 rests on a plane, horizontal surface as shown in FIGS. 2 and 3.

Figure 4:
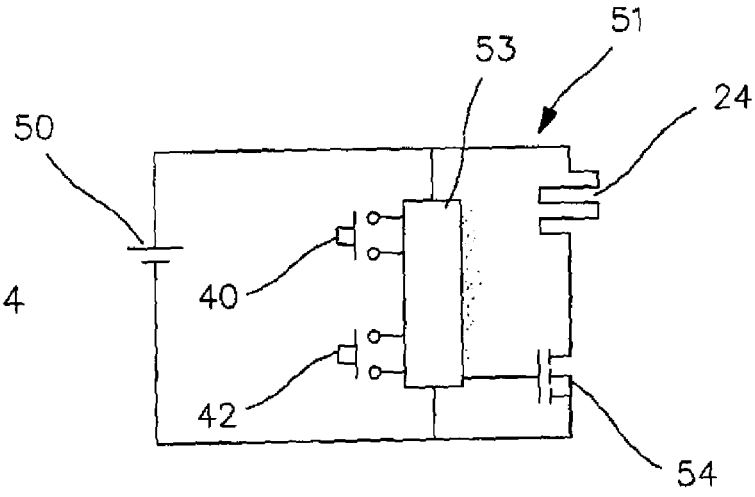
FIG. 4 is a circuit diagram showing an exemplary embodiment of an electrical power circuit for use with the applicator in FIGS. 1 to 3.

As shown in FIG. 4, the applicator 2 includes an independent electricity source 50, e.g. one or more optionally-rechargeable batteries, housed in the casing 20, and an electrical power circuit 51 that manages the power supply to the heater member 24.

The applicator 2 includes control means that enable the user to switch the applicator from an OFF or standby state to an ON state, the control means comprising an ON/OFF switch 40, for example, that is present on the casing 20 of the applicator.

The device 1 may also include detector that make it possible to detect the engagement of the applicator 2 with the container 3 in order to modify the power supply to the heater member 24, at least temporarily, following that detection.

In the embodiment in FIGS. 1 to 3, the applicator 2 includes a switch 42 that is actuated automatically when the applicator 2 is in place on the container.

By way of example, the switch 42 is a pushbutton that is present on the casing 20 or on the applicator head 21, and that is displaced in such a manner as to change state when the applicator 2 is put into place on the container 3.

The electrical power circuit 51 that is present in the applicator 2 detects the change in state of the switch 42, and that detection may trigger the start of a predefined operating stage during which the power supply to the heater member 24 is boosted in such a manner as to dissipate power that is higher than the power normally needed to maintain the heater member 24 at its service temperature. By way of example, the boosting stage makes it possible to raise the temperature of the heater member 24 very quickly and/or makes it easier to load the applicator with composition.

During the boosting stage, the temperature of the heater member 24 may reach more than 90° C. for example, whereas the service temperature of the heater member 24 ranges from about 60° C. to about 70° C., for example.

During the boosting stage and by way of example, the heater member 24 is powered at a voltage that is greater than the voltage corresponding to it being maintained at its service temperature, e.g. a voltage of 3 volts (V), whereas the voltage corresponding to the service temperature is 2 V.

By way of example, the power circuit 51 of the heater member 24 includes a chopper power supply, and the heater member 24 is powered with a variable duty ratio.

Detecting the presence of the applicator 2 in the housing 5 may cause the duty ratio to be varied, for example the heater member 24 may be powered during the power-boosting stage with a duty ratio that is greater than the duty ratio that suffices to maintain the heater member 24 at its service temperature.

During the boosting stage, the heater member 24 may be powered continuously, for example.

During the stage of maintaining the heater member at its service temperature, the voltage of the independent electrical energy source 50 may be measured in order to know its depletion state, and the duty ratio may vary as a function of the depletion state of the independent energy source 50, with the duty ratio tending to increase as the voltage of the source decreases.

The duration during which the heater member is power-boosted may be defined by a timer, so as to avoid the electricity source of the applicator being needlessly depleted in the event of the heater member being maintained on the container 3 for a long period.

The applicator 2 may be configured to switch off automatically in the event of it not being used for a long period.

The applicator 2 may include an indicator 44, such as, for example, a light, in order to signal to a user that the applicator 2 is ready for use, e.g. the service temperature has been reached.

In the event of the applicator switching off automatically, e.g. as a result of being engaged too long with the container 3, the indicator 44 switches off and the user is thus informed that a new press is needed on the on/off switch 40 before the composition may be applied.

The electrical circuit 51 powering the heater member 24 may also be configured so that when the applicator 2 is switched on, if the presence of the applicator 2 is detected as being engaged with the container, then the heater member 24 is power-boosted for a predefined duration.

The electrical circuit 51 powering the heater member 24 may also be configured so that in the event of the applicator 2 being removed from the container 3, the power supply to the heater member 24 is immediately modified so as to return said heater member 24 as quickly as possible to its service temperature, which is compatible with application to keratinous materials. The change in state of the switch 42 may be observed for this purpose.

The device 1 may include detector means that make it possible to detect the removal of the applicator 2 from the container 3, so as to return the power supply of the heater member to the first powering mode, also referred to as "service mode".

When the applicator 2 includes a rechargeable battery, the applicator 2 may be put into place on the container 3 in order to recharge the battery, e.g. by means of electrical contacts present on the container 3 that cooperate with electrical contacts of the applicator 2.

The engagement of the applicator 2 with the container 3 may be detected other than by detecting a change in the state of a switch 42 as described above. For example, the applicator 2 includes a magnetic switch of the reed or inductive load switch (ILS) type, and the container 3 includes a magnet that is disposed in such a manner as to cause the state of the magnetic switch to change when the applicator 2 is in place on the container 3.

The applicator 2 may also include an optical switch, e.g. a photodiode or a phototransistor, that changes state when the applicator 2 is in place in the container 3, e.g. as a result of: a light beam emitted by the applicator 2 being interrupted; a light beam emitted by the applicator 2 being reflected to the applicator 2; and/or a light beam emitted by the container 3 being received by the applicator 2.

Alternatively, the engagement of the applicator 2 with the container 3 may be detected by detecting contact pressure exerted on the applicator 2, e.g. at the applicator head 21, e.g. pressure on the heater member 24. By way of example, the applicator head 21 may include a pressure sensor that is disposed beneath the heater member 24, such that the pressure of the heater member 24 against the bottom of the housing 5 is detected. The electrical power circuit present in the applicator 2 may be configured to trigger the boosting stage following such detection.

Alternatively, the presence of the applicator 2 in the housing 5 of the container 3 may be detected by means of electrical contacts of the applicator 2 coming into contact with electrical contacts of the container 3.

Where appropriate, the electrical energy needed to power-boost the heater member may come from an auxiliary electricity source that is disposed in the container. For example, the applicator may include first electrical contacts, and the container may include second electrical contacts. When the applicator is in place in the container, the heater member may be powered at a greater voltage by means of the first and second contacts, for example.

The electrical circuit 51 of the applicator 2 comprises all of the components that enable the heater member 24 to be electrically powered during the design operating stages.

The electrical circuit 51 may include a micro-controller that is programmed to provide the desired functions.

The electrical circuit 51 may also include at least one electronic switch 54 that is connected in series with the heater member 24, and that makes it possible to supply power with the desired duty ratio, for example.

Figure 5:
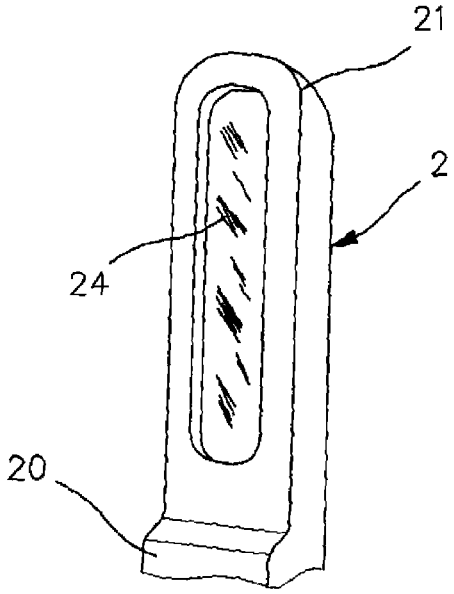
FIG. 5 is a partial perspective view of another exemplary embodiment of an applicator in accordance with the present teachings.

In the exemplary embodiment of FIG. 5, the longitudinal axis of the heater member 24 is substantially parallel to the longitudinal axis of the applicator 2

The presence of the heater member 24 in the housing 5 of the container 3 may be detected in manner similar to that described above.

Figure 6:
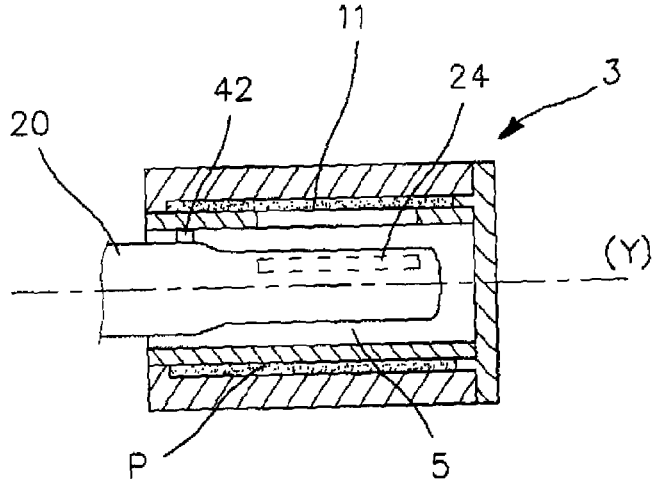
FIG. 6 is a partial longitudinal section of the applicator of FIG. 5 applicator inserted into an exemplary embodiment of a container in accordance with the present teachings.

With such a configuration of the heater member 24, said heater member 24 is for example loaded with composition by being inserted into a housing 5 that is open at its side, e.g. a housing 5 of horizontal longitudinal axis Y, as shown in FIG. 6.

The container 3 may be arranged to deposit a certain quantity of composition on the heater member 24 when said heater member is present in the housing 5. By way of example, the container 3 includes an outlet 11 for dispensing the composition, said outlet overlying the heater member 24, and enabling the composition to be deposited on said heater member 24.

The composition P may be brought to the outlet 11 in various ways, e.g. by means of a movable member that pushes the composition towards the outlet, or that transports a certain quantity thereof, taken from a reservoir.

The container 3 may also include a plurality of doses of composition P waiting to be dispensed, and may be configured to enable the user to dispense the doses one by one onto the heater member 24.

FIGS. 7 to 17 show various exemplary embodiments heater members that may be used as heater member 24.

The heater member may comprise a substrate 28 and a resistor wire 27.

By way of example, the wire 27 is made of cupro-nickel or nickel-chromium alloy and may present a diameter ranging from about 0.1 millimeters (mm) to about 0.5 mm, e.g. about 0.2 mm, and a length ranging from about 120 mm to about 180 mm, e.g. about 150 mm.

The wire 27 may be electrically insulated.

In an example, the wire is of NiCr alloy and insulated by covering with PTFE, and in another example, the wire is cupro-nickel alloy covered with enamel.

The substrate 28 may be selected from conductive metals such as aluminum, steel, or a copper-based alloy.

The wire 27 may form turns that may be optionally touching.

In an example, the wire 27 is not insulated and the substrate 28 associated with such a heater wire 27 is thus made of a material that is not electrically conductive, e.g. a ceramic, a silicone rubber, or some other heat-resistant plastics material.

Using a non-stick ceramic for making the substrate 28 may make it possible to remove the cosmetic composition P applied to the heater surface relatively easily when the heater member has cooled down.

Figure 7:
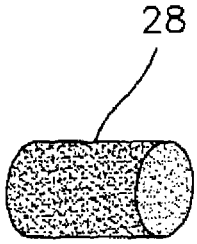
FIGS. 7 to 17 are perspective views of various exemplary embodiments of heater members in accordance with the present teachings.

In the exemplary embodiment of FIG. 7, the substrate 28 is a hollow cylinder having an outside diameter, for example of about 4 mm, an inside diameter, for example, of about 3 mm, and a length, for example, of about 25 mm. The hollow cylinder defines an inner housing that is not visible and in which there is disposed the wire 27, e.g. a spiral-wound wire made of NiCr alloy, having a diameter of about 0.17 mm and a length of about 150 mm.

When the substrate 28 is made of a material that is not electrically conductive, such as, for example, ceramic, the substrate 28 may be overmolded on the heater wire 27.

Figure 8:
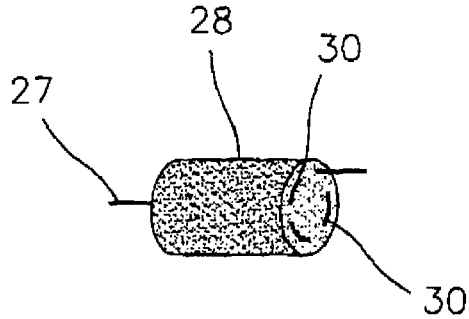
Figure 9:
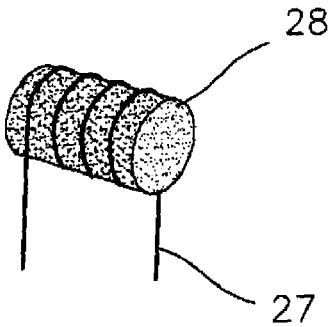

In the exemplary embodiment of FIG. 8, the substrate 28 is a cylinder including a plurality of through holes 30, the through holes 30 extending along the longitudinal axis of the substrate 28. In the FIG. 9, the cylinder is pierced with four holes 30, though those having ordinary skill in the art would understand that any number of holes 30 may be provided. The wire 27 is wound through the holes 30.

Figure 10:
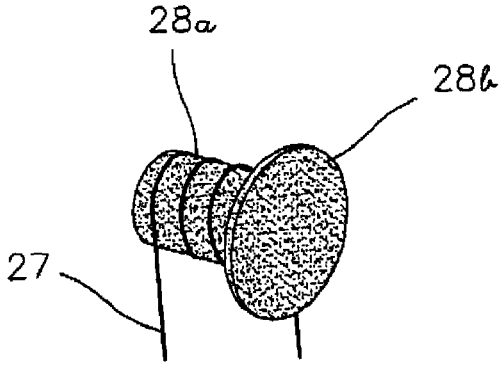

FIG. 10 shows an exemplary embodiment of a substrate 28 that is peg shaped and includes a solid cylindrical body 28*a* that is surmounted by a thin head 28*b*. The wire 27 is wound around the cylindrical body 28*a*. In a variant, the cylindrical body 28*a* is hollow.

Figure 11:
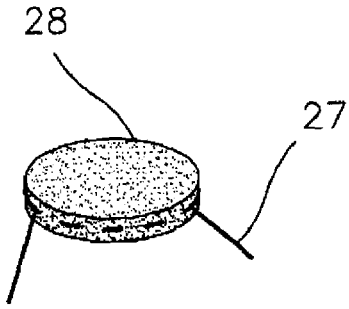

In FIG. 11, the substrate 28 is a thin disk, the wire 27 passing through holes in the thickness of the disk.

Figure 12:
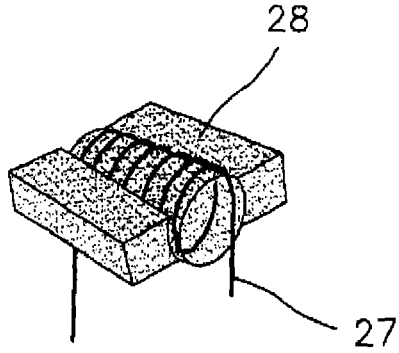

In the exemplary embodiment of FIG. 12, the wire 27 includes a helical winding that is partially embedded in the thickness of the substrate 28.

Figure 13:
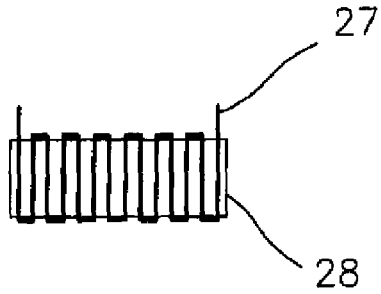
Figure 14:
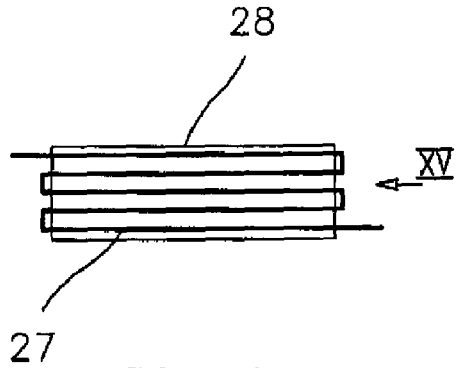
Figure 15:
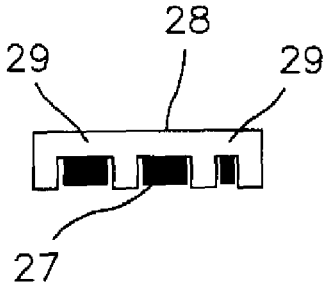

In FIGS. 13 to 17, the substrate 28 is plate shaped. In its thickness, the plate may include a plurality of grooves 29 in which the wire 27 passes, as shown in FIG. 15.

In this example, the substrate 28 has a length of about 25 mm, a width of about 4 mm, a height of about 3 mm, and includes five grooves each having a width of about 0.5 mm, for example.

Figure 16:
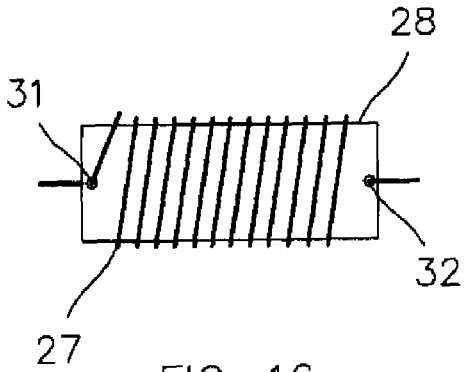
Figure 17:
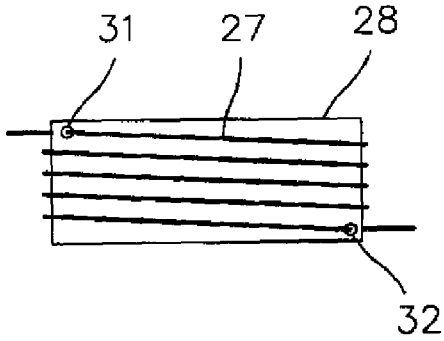

In the example in FIGS. 16 and 17, the substrate 28 is in the form of a plate that does not have grooves, having a length of about 25 mm, a width of about 3 mm, and a height of about 0.5 mm, for example. The substrate 28 of FIGS. 16 and 17 may include two holes 31 and 32 serving as the arrival point and as the start point respectively of the wire 27.

The wire may be wound longitudinally, as shown in FIGS. 14 and 17, or transversally, as shown in FIGS. 13 and 16.

The heater member may be made in some other way.

In another exemplary embodiment, the user may act directly to boost power to the heater member, independently of it being inserted in the container.

The expression "comprising a" should be understood as "comprising at least one" unless specified to the contrary.

Although the present invention herein has been described with reference to various exemplary embodiments, it is to be understood that these embodiments are merely illustrative of the principles and applications of the present teachings. It is therefore to be understood that numerous modifications may be made to the illustrative embodiments and that other arrangements may be devised without departing from the spirit and scope of the present teachings and appended claims.

What is claimed is:

1. A device for loading and applying a cosmetic composition, the device comprising:

an applicator comprising an electric heater member;

a container containing the composition, the container comprising a housing configured to receive at least part of the applicator so as to load the applicator with the composition; and an electrical circuit configured to power the heater member, the circuit being configured so that the power supply to the heater member is automatically modified, leading to an increase in the electric power that is dissipated by the heater member when said heater member is received in the housing, when a predefined condition relating to the at least part of the applicator being received in the housing is satisfied.

2. A device according to claim 1, wherein the increase in the electric power dissipated, leading to an increase in the temperature of the heater member, raises a temperature of the heater member up to at least about 85° C.

3. A device according to claim 1, wherein the power circuit is housed at least partially in the applicator.

4. A device according to claim 1, wherein the applicator comprises an independent electrical energy source.

5. A device according to claim 1, wherein the applicator comprises at least one switch, and the predefined condition is a modification in a state of the at least one switch.

6. A device according to claim 5, wherein the at least one switch interacts mechanically with the container in order to change state.

7. A device according to claim 5, wherein the at least one switch interacts magnetically with the container in order to change state.

8. A device according to claim 5, wherein the at least one switch interacts optically with the container in order to change state.

9. A device according to claim 1, wherein the container comprises an auxiliary electrical energy source, the heater member being powered by the auxiliary electrical energy source when the applicator is inserted in the container.

10. A device according to claim 1, wherein the electrical circuit comprises a timer configured to control the automatic modification in the power supply to occur for a predefined duration.

11. A device according to claim 1, wherein the applicator comprises a handle portion and an applicator head including the heater member.

12. A device according to claim 11, wherein the housing extends along a vertical axis when the container is placed on a plane horizontal surface, and the applicator head has a surface for coming into contact with keratinous materials that extend generally perpendicularly to a longitudinal axis of the applicator.

13. A device according to claim 11, wherein the housing extends along a horizontal axis when the container is placed on a plane horizontal surface, and the applicator head has a surface for coming into contact with keratinous materials that extend generally parallel to a longitudinal axis of the applicator.

14. A device according to claim 1, wherein the composition is in powder form in the container.

15. A device according to claim 1, wherein the composition is configured to be applied to keratinous fibers.

16. A method of loading an applicator with a cosmetic composition, the method comprising:

inserting an applicator comprising a heater member into a container containing a composition;

detecting if a predefined condition relating to the presence of the applicator in the container is satisfied; and automatically modifying a power supply to the heater member if the predefined condition is satisfied so as to increase the electric power that is dissipated by the heater member.

17. A method according to claim 16, wherein the automatically modifying the power supply comprises automatically modifying the power supply for as long as the predefined condition is satisfied.

18. A method according to claim 16, wherein the automatically modifying the power supply comprises automatically modifying the power supply for a predefined duration.

19. A method according to claim 16, wherein the detecting if a predefined condition is satisfied comprises detecting a state of a switch during the inserting of the applicator into the container.

20. A device for loading and applying a cosmetic composition, the device comprising:

an applicator comprising an electric heater member;

a container containing the composition, the container comprising an auxiliary electrical energy source and a housing configured to receive at least part of the applicator so as to load the applicator with the composition; and an electrical circuit configured to power the heater member, the circuit being configured to automatically modify the power supply to the heater member when a predefined condition relating to the applicator being inserted into the housing is satisfied, wherein the auxiliary electrical energy source is configured to power the heater member when the applicator is engaged with the container.

21. A device for loading and applying a cosmetic composition, the device comprising:

an applicator comprising an electric heater member;

a container containing the composition, the container comprising a housing configured to receive at least part of the applicator so as to load the applicator with composition; and an electrical circuit configured to power the heater member, the circuit being configured to automatically modify a power supply to the heater member when a predefined condition relating to the at least part of the applicator being inserted into the housing is satisfied, wherein the electrical circuit comprises a timer configured to control the automatic modification to the power supply to occur for a predefined duration.

* * * * *